US006652134B2

(12) United States Patent
Lloyd

(10) Patent No.: US 6,652,134 B2
(45) **Date of Patent: *Nov. 25, 2003**

(54) PORTABLE BEVERAGE DELIVERY SYSTEM

(76) Inventor: James J. Lloyd, 21 Cala d'Or, Laguna Niquel, CA (US) 92677

( * ) Notice: Subject to any disclaimer, the term of this patent is extended or adjusted under 35 U.S.C. 154(b) by 0 days.

This patent is subject to a terminal disclaimer.

(21) Appl. No.: 10/109,524

(22) Filed: Mar. 28, 2002

(65) Prior Publication Data

US 2002/0101780 A1 Aug. 1, 2002

Related U.S. Application Data

(63) Continuation of application No. 09/952,623, filed on Sep. 14, 2001, now Pat. No. 6,439,757, which is a continuation of application No. 09/414,617, filed on Oct. 8, 1999, now abandoned.

(51) Int. Cl.[7] ..... B01F 3/08

(52) U.S. Cl. ..... 366/130; 206/219; 206/427

(58) Field of Search ..... 366/130, 192, 366/341, 349; 206/219, 221, 427, 429, 431, 568; 222/92–94, 105, 129, 129.1, 130, 156, 183, 185.1; 224/148.7

(56) References Cited

U.S. PATENT DOCUMENTS

| | | | |
|---|---|---|---|
| 2,058,027 A | | 10/1936 | Martinet |
| 2,411,196 A | | 11/1946 | Dolan, II |
| 3,212,681 A | | 10/1965 | Weikert |
| 3,435,990 A | | 4/1969 | Pike, Jr. |
| 4,143,795 A | | 3/1979 | Casebier |
| 4,757,920 A | | 7/1988 | Harootian, Jr. et al. |
| 4,875,586 A | * | 10/1989 | Chaussadas |
| 5,050,775 A | | 9/1991 | Marquardt |
| 5,085,346 A | | 2/1992 | Wright |
| 5,186,359 A | | 2/1993 | Brown et al. |
| 5,413,251 A | | 5/1995 | Adamson |
| 5,673,817 A | | 10/1997 | Mullen et al. |
| 6,159,513 A | | 12/2000 | Judlowe et al. |
| 6,213,297 B1 | * | 4/2001 | Gale |
| 6,325,210 B1 | * | 12/2001 | Henry, Jr. |

OTHER PUBLICATIONS

Jose Cuervo Margarita Ball—one photograph of specimen.

* cited by examiner

*Primary Examiner*—Charles E. Cooley
(74) *Attorney, Agent, or Firm*—Stetina Brunda Garred & Brucker

(57) ABSTRACT

A portable beverage delivery system for preparing and delivering a multi-component beverage whose plurality of individual components can be maintained separately for subsequent combination to form the beverage. A first embodiment includes a housing with a mixing chamber disposed therein to form the final beverage product. The chamber has an introduction aperture and an exit aperture which are separate or are the same, and the housing has an opening through which the exit aperture is accessible and through which a mixed beverage can be dispensed. A second embodiment is a two chamber structure disposed within a housing and having a first chamber for containing a first beverage element, a second chamber for containing a second beverage element, and an exit aperture. The chambers are separated by a frangible wall whereby rupture thereof results in mixing of the first and second liquids of the multi-component beverage to form the beverage product which then can be dispensed through the exit aperture.

15 Claims, 5 Drawing Sheets

PORTABLE BEVERAGE DELIVERY SYSTEM

CROSS-REFERENCE TO RELATED APPLICATIONS

The present application is a continuation of application Ser. No. 09/952,623, filed Sep. 14, 2001, now U.S. Pat. No. 6,439,757 entitled PORTABLE BEVERAGE DELIVERY SYSTEM, which is a continuation of U.S. patent application Ser. No. 09/414,617 entitled PORTABLE BEVERAGE DELIVERY SYSTEM filed Oct. 8, 1999, which has been abandoned, the entirety of the disclosures of which are expressly incorporated herein by reference.

STATEMENT RE: FEDERALLY SPONSORED RESEARCH/DEVELOPMENT (Not Applicable)

FIELD OF THE INVENTION

This invention relates in general to beverage packaging and dispensing, and in particular to a portable beverage delivery system wherein one component, non-limitedly exemplified as liquor, of a multi-component beverage, non-limitedly exemplified as a cocktail, can be maintained separately from one or more other components, non-limitedly exemplified as a carbonated mixer, for subsequent combination to form the multi-component beverage within the delivery system and provide dispenser-delivery therefrom upon call.

BACKGROUND OF THE INVENTION

In general, beverages can be divided into single-component and multi-component products. Examples of the former include soft drinks such as various colas, soda, root beer, water, coffee, tea, wine, beer, etc., while examples of multi-component products include alcoholic drinks containing liquor and mixer such as bourbon and soda, scotch and water, rum and cola, etc. The latter products typically contain a relatively small amount of liquor and a relatively large amount of mixer.

Because governmental taxation of a packaged alcoholic product such as a bottle of liquor is based on the volume of the bottle as opposed to weight or concentration of liquor present, beverage producers cannot afford to sell pre-mixed cocktails since, even though a packaged cocktail container may contain only one ounce of liquor and seven ounces of mixer, taxation would be based on the total of eight, and not one, ounces of liquor. Consequently, a consumer is forced to inconveniently transport at least two separate containers (e.g. liquor and mixer) when taking refreshments to an outside function, and must thereafter locate accommodations that permit a proper mixing and serving procedure. Especially with outdoor functions, such accommodations many times are not available, thereby precluding availability of mixed-beverage products.

In view of the above hindrances, it is apparent that a need is present for convenient, yet equitably priced, packaging that allows carriage of separate components of a multi-component beverage, with subsequent integral mixing capabilities as part of the packaging for final production of a mixed-beverage product. In accord therewith, a primary object of the present invention is to provide a portable beverage delivery system for preparing and delivering a multi-component beverage through interaction of components separately maintained until final beverage production occurs.

Another object of the present invention is to provide a portable beverage delivery system that includes a mixing chamber into which separate beverage components can be introduced and mixed, and from which a resultant multi-component beverage can be controllably dispensed.

Yet another object of the present invention is to provide a portable beverage delivery system wherein a separately packaged container bearing one component of a final beverage product can be accommodated.

These and other objects of the present invention will become apparent throughout the description thereof which now follows.

BRIEF SUMMARY OF THE INVENTION

The present invention is a portable beverage delivery system for preparing and delivering a multi-component beverage whose plurality of individual components can be maintained separately for subsequent combination to form the beverage. First embodiments comprise a housing with a mixing chamber disposed therein for mixing the individual components of the beverage to form the final beverage product. The chamber has a closeable introduction aperture thereto through which the individual components can enter the chamber, and a closeable exit aperture therefrom through which the beverage can be dispensed. Introduction and exit apertures can be separate from each other, or the exit aperture can be constructed to also function as an introduction aperture by permitting introduction of components into the chamber. A compartment is disposed within the housing for carrying a container such as a bottle bearing at least one of the individual components. The housing has an opening in substantial alignment with the exit aperture through which the exit aperture of the container is accessible and through which the beverage can be dispensed.

A second embodiment is a two chamber structure for preparing and delivering a multi-component beverage, and comprises a first chamber for containing a first liquid containing at least one component of the multi-component beverage and a second chamber for containing a second liquid containing at least one component of the multi-component beverage. The first and second chambers are separated by a frangible wall, and one chamber has a closeable exit aperture therefrom through which a final beverage product can be dispensed. Rupture of the frangible wall results in mixing of the first and second liquids of the multi-component beverage to form the beverage product which then can be dispensed through the exit aperture. The two-chamber structure can be disposed within a housing that has an opening in substantial alignment with the closeable exit aperture through which the exit aperture is accessible and through which the beverage can be dispensed.

Third embodiments comprise a housing with solely one mixing chamber disposed therein for receiving and mixing the individual components of the beverage as those components are introduced separately to form the final beverage product. Such component introduction can be through a dedicated introduction aperture or through the exit aperture which is constructed to also permit introduction of components into the chamber.

The portable delivery system here taught thus permits preparation and delivery of a multi-component beverage through interaction of components when desired, yet separately maintains these components until such final beverage production occurs. In this manner a singly-packaged system accomplishes convenient on-site generation of a multi-component beverage which otherwise may not practically be packageable or transportable.

BRIEF DESCRIPTION OF THE DRAWINGS

Illustrative and presently preferred embodiments of the invention are shown in the accompanying drawings in which.

DETAILED DESCRIPTION OF THE PREFERRED EMBODIMENTS

Figure 1:
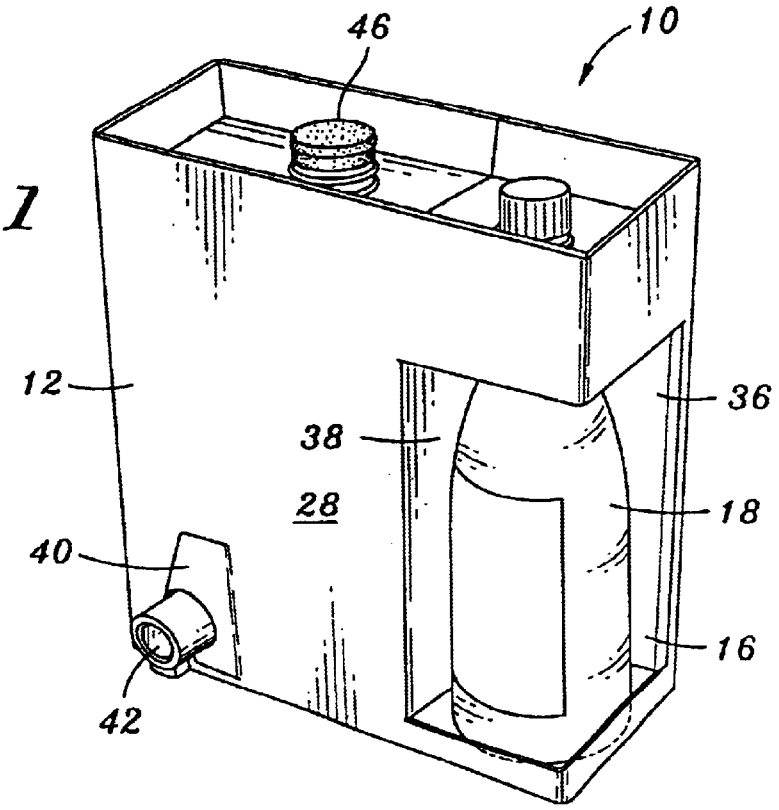
FIG. 1 is a perspective view of a first embodiment of a portable beverage delivery system.
Figure 2:
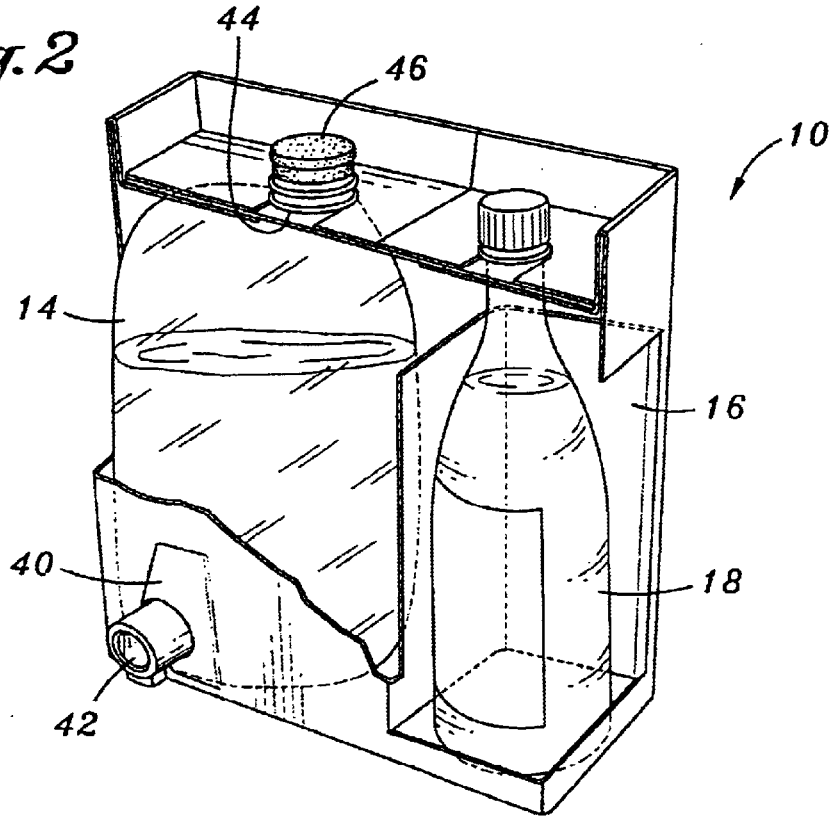
FIG. 2 is a perspective view partially in section of the embodiment of FIG. 1.
Figure 3:
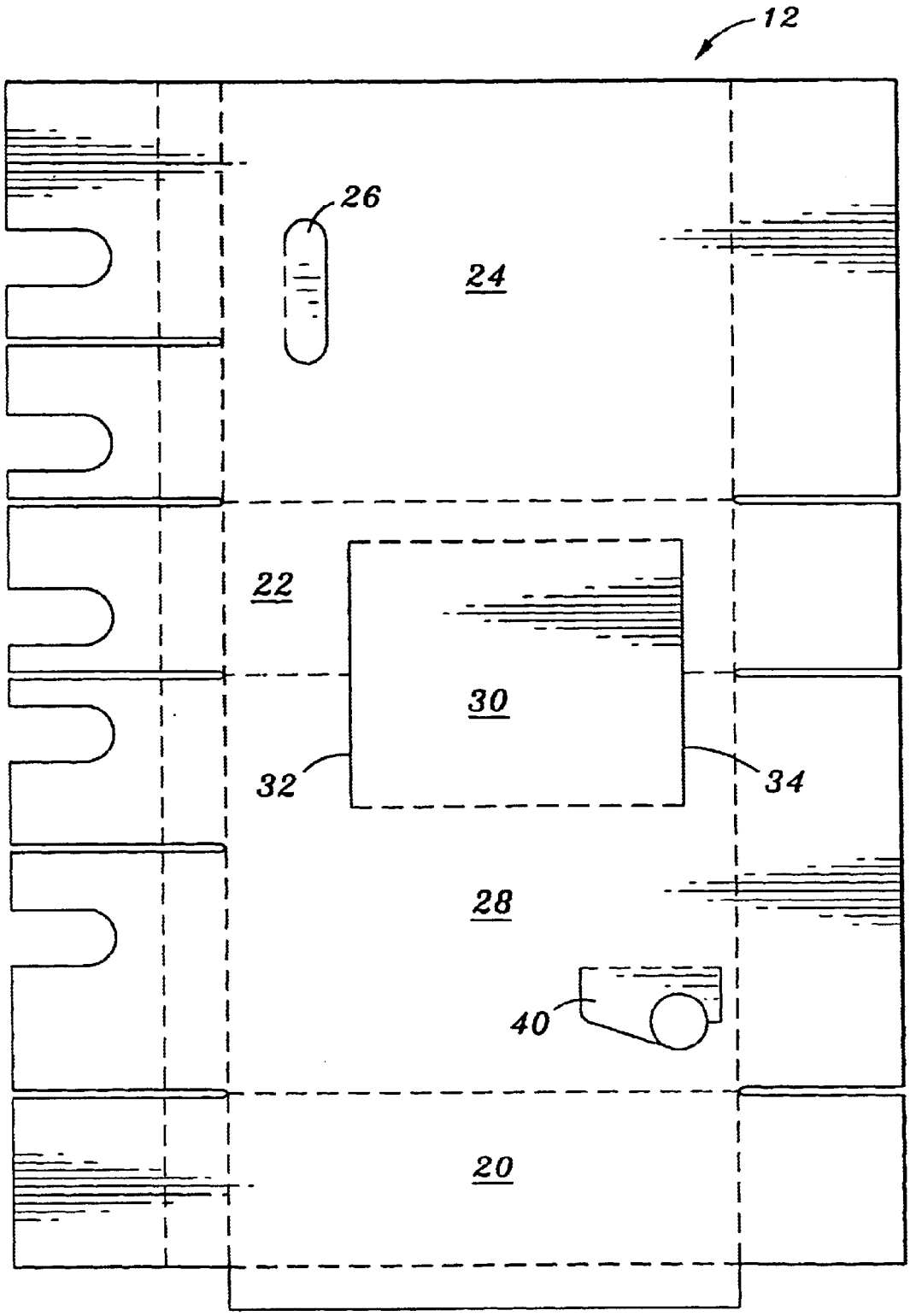
FIG. 3 is a side elevation view of a cardboard housing blank of the embodiment of FIG. 1.

Referring first to FIGS. 1–3, a first embodiment of a portable beverage delivery system 10 is illustrated. The system 10 includes a cardboard housing 12, whose blank is shown in FIG. 3, for housing a preferably flexible-walled mixing chamber 14 and providing a compartment 16 within which a container such as a bottle 18 can be retained. As particularly shown in FIG. 3, the housing 12 has two opposing side panels 20, 22, a rear panel 24 with a cut-out 26 for hand-carry placement, and a front panel 28. A generally rectangular portion 30 of the front panel 28 and bridging equidistantly from the front panel 28 to the side panel 22 is cut along its top 32 and bottom 34 borders to thereby be foldable inwardly to provide the wall portions 36, 38 of the compartment 16 as shown in FIG. 1. The front panel 28 additionally has a spout cut-out 40 to accommodate placement of a spout 42 leading from the mixing chamber 14. The mixing chamber 14 is leak proof and can be constructed of a polymer such as polyethylene. A top opening 44 permits liquid introduction into the chamber 14 upon removal of a conventional friction-fit lid 46. A standard hand-operable valve spout 42 is situated near the bottom of the chamber 14 to allow controlled exit of liquid from the chamber 14.

In operation, a user of the first embodiment places a mixer-component liquid into the mixing chamber 14 through the opening 44 while maintaining a second liquid component such as liquor within the bottle 18 housed in the compartment 16. When two-component beverages are wanted, the user pours the liquid component from the bottle 18 into the mixing chamber 14 for blending with the already-present mixer component. Thereafter, the user dispenses the completed beverage through the spout 42 into a glass or other drinking container. If desired, the wall portions 36, 38 can be moved outwardly to thereby generally close the compartment 16, and ice or other source of cold can be placed in the compartment 16 to function as a refrigerant.

Figure 4:
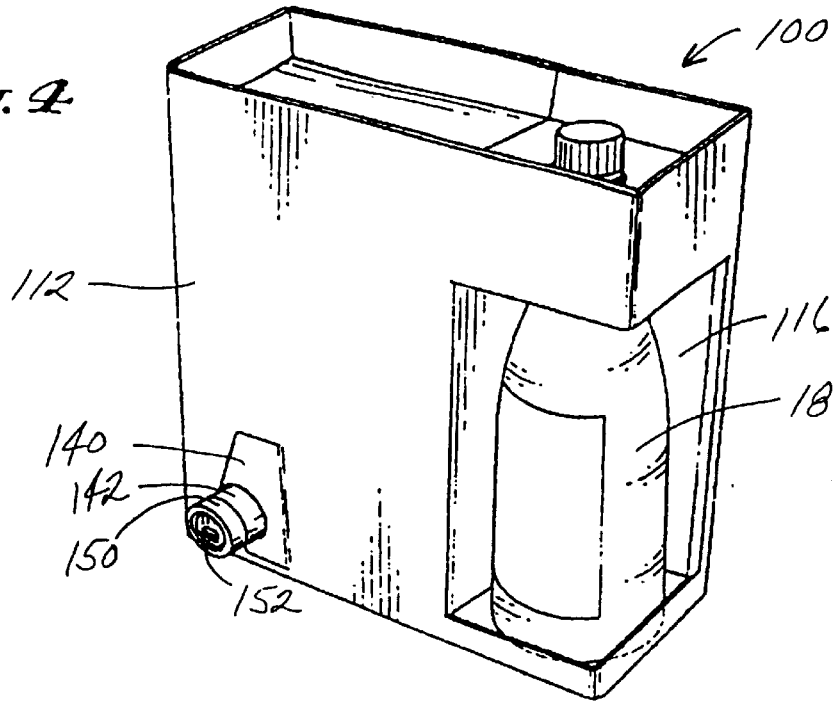
FIG. 4 is a perspective view of a second embodiment of a portable beverage delivery system.
Figure 5:
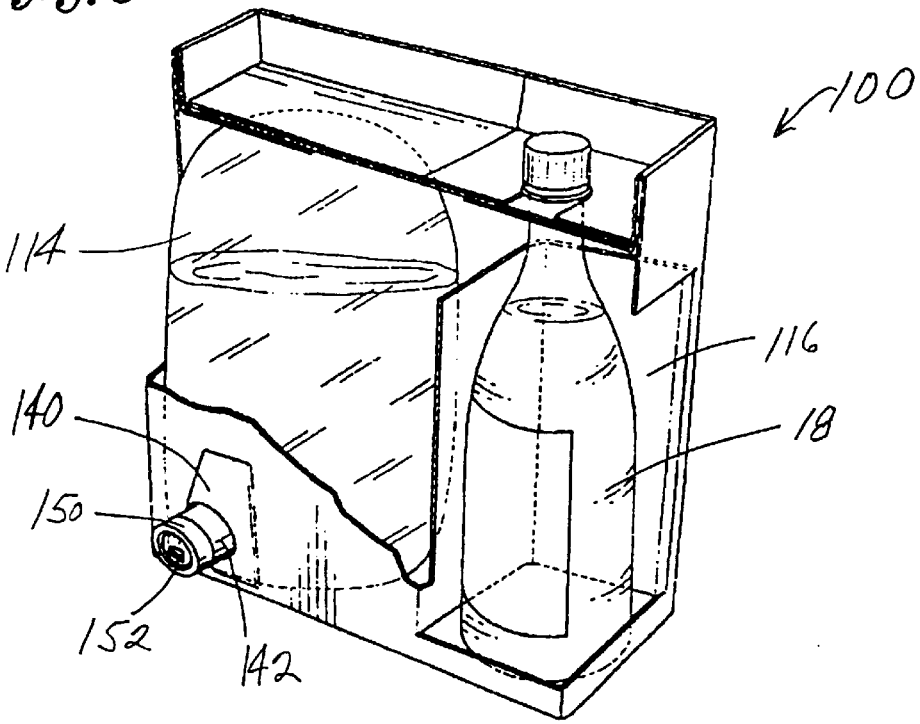
FIG. 5 is a perspective view partially in section of the embodiment of FIG. 4.

FIGS. 4 and 5 show a second embodiment of a beverage delivery system 100 that includes a cardboard housing 112 for housing a preferably flexible-walled mixing chamber 114 and providing a compartment 116, constructed in substantially the same manner as the compartment 16 of the embodiment of FIGS. 1–3, within which a container such as a bottle 18 can be retained. A spout cut-out 140 is provided in the housing 112 to accommodate a spout 142 provided to the mixing chamber 114. The spout 142 has a removable cover 150 in which is provided a hand operable valve 152 to thereby allow controlled passage of liquid from the chamber 114. In the same manner as the first embodiment earlier described, the mixing chamber 114 is leak proof and can be constructed of a polymer such as polyethylene.

In operation, a user of the second embodiment places a mixer-component liquid into the mixing chamber 114 through the spout 142 by removing the cover 150 from the spout 142 after turning the housing generally upside down. A second liquid component such as liquor is maintained within the bottle 18 housed in the compartment 116. When two-component beverages are wanted, the user pours the liquid component from the bottle 18 into the mixing chamber 114 likewise through the spout 142 by removing the cover 150 from the spout 142 after turning the housing generally upside down. Blending of the two liquids then occurs and the user dispenses the completed beverage through the spout 142 into a glass or other drinking container. If desired, the wall portions 136, 138 can be moved outwardly to thereby generally close the compartment 116 as in the first embodiment, and ice or other source of cold can be placed in the compartment 16 to function as a refrigerant.

Figure 6:
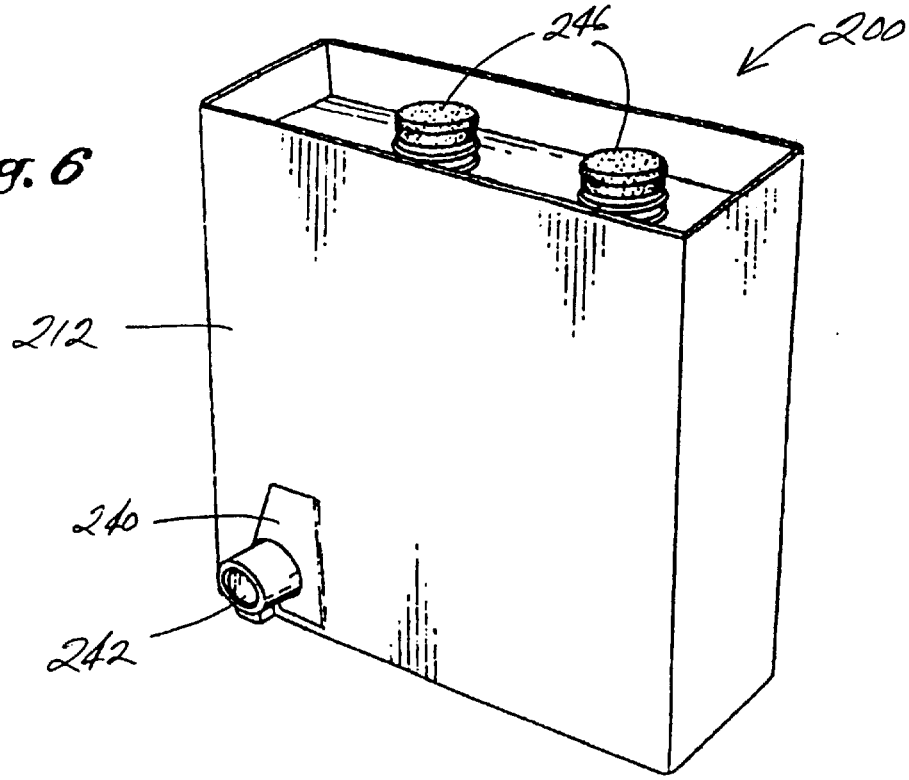
FIG. 6 is a perspective view of a third embodiment of a portable beverage delivery system.
Figure 7:
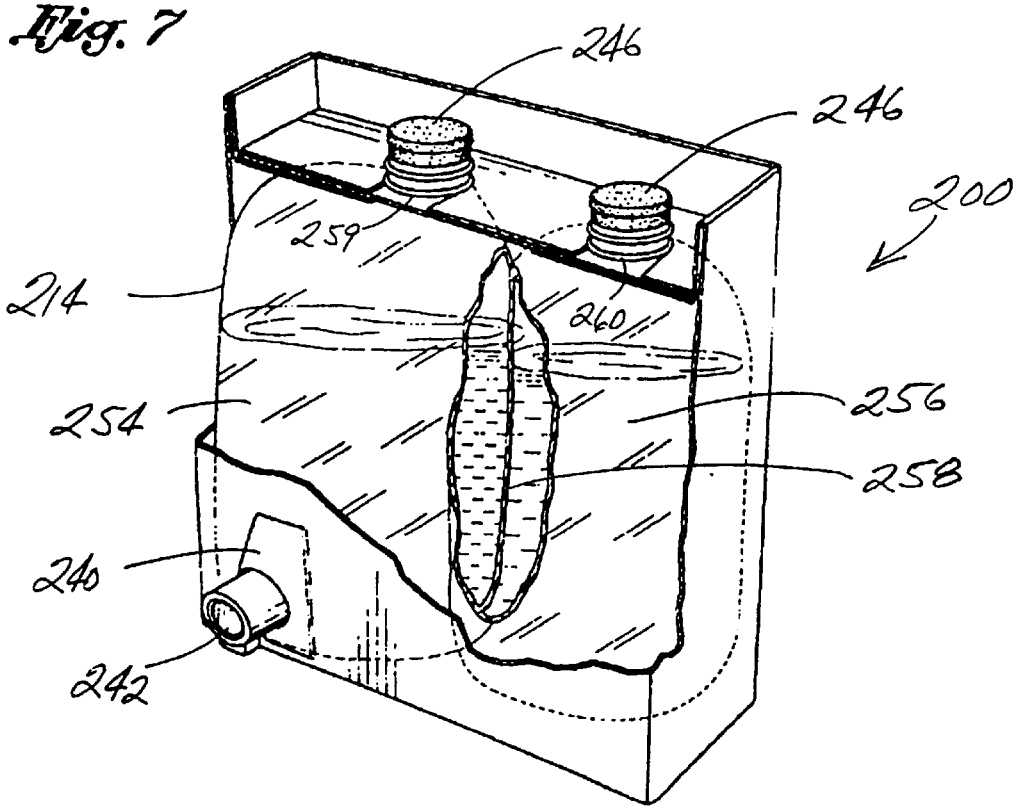
FIG. 7 is a perspective view partially in section of the embodiment of FIG. 6.

FIGS. 6 and 7 show a third embodiment of a beverage delivery system 200 that includes a cardboard housing 212 for housing a two-compartment flexible-walled mixing chamber 214 which is leak proof and can be constructed of a polymer such as polyethylene. As is illustrated, the mixing chamber 214 has two compartments 254, 256 separated from each other by a frangible wall 258 rupturable by application of hand pressure against the chamber 214. Each compartment 254, 256 has a respective top opening 259, 260 that permits liquid introduction into the compartments 254, 256 upon removal of respective conventional friction-fit lids 246. A single standard hand-operable valve spout 242 is situated near the bottom of the chamber 214 and is accommodated by a spout cut out 240 through the housing 212 to allow controlled exit of liquid.

In operation, a user of the third embodiment places a mixer-component liquid into one compartment 254 and a second liquid component such as liquor into the other compartment 256. When two-component beverages are wanted, the user applies a squeezing hand pressure upon the chamber 214 to thereby rupture the frangible wall 258 and accomplish blending of the liquids. Thereafter, the user dispenses the completed beverage through the spout 242 into a glass or other drinking container.

Figure 8:
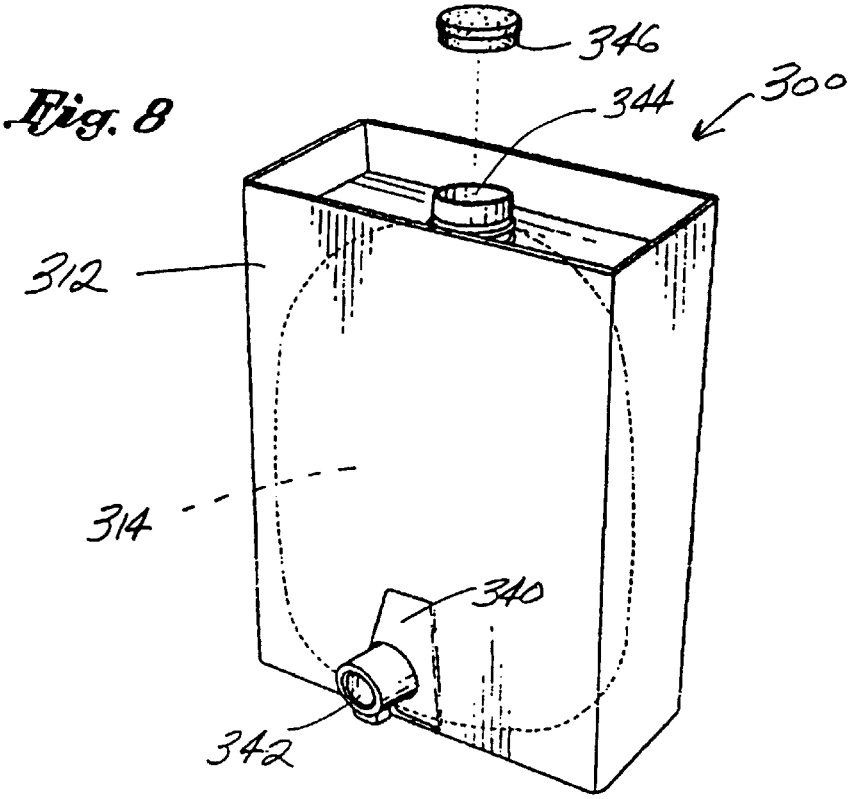
FIG. 8 is a perspective view of a fourth embodiment of a portable beverage delivery system.

FIG. 8 shows a fourth embodiment of a beverage delivery system 300 that includes a cardboard housing 312 for housing a flexible-walled mixing chamber 314. The mixing chamber 314 is leak proof and can be constructed of a polymer such as polyethylene. A top opening 344 permits liquid introduction into the chamber 314 upon removal of a conventional friction-fit lid 346. A standard hand-operable valve spout 342 is situated near the bottom of the chamber 314 and is accommodated by a spout cut out 340 through the housing 312 to allow controlled exit of liquid. to allow controlled exit of liquid from the chamber 314.

In operation, a user of the fourth embodiment introduces all components of a desired beverage into the chamber 314 through the opening 344. Thereafter, the user dispenses the completed beverage through the spout 342 into a glass or other drinking container.

Figure 9:
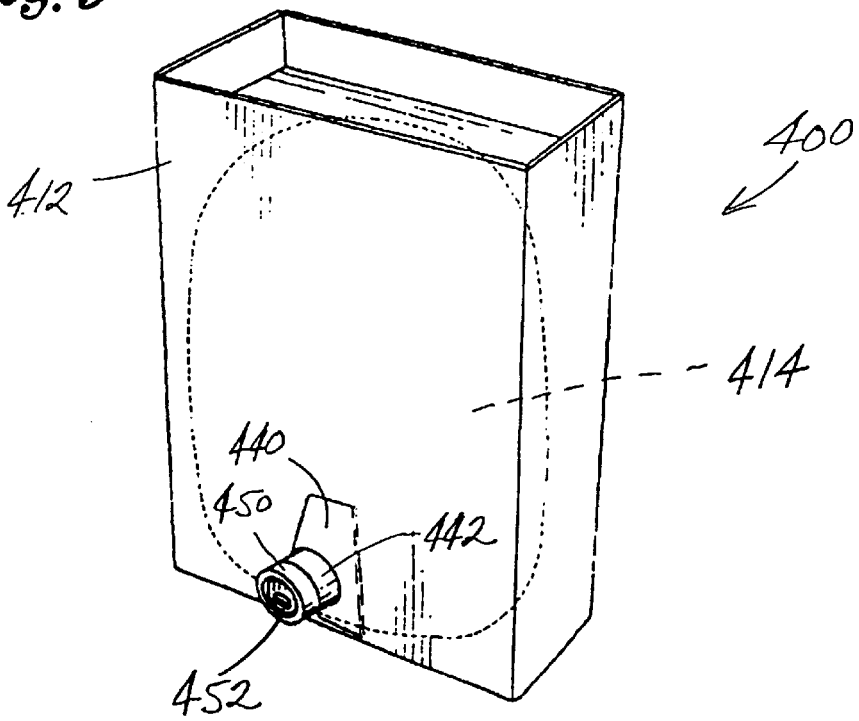
FIG. 9 is perspective view of a fifth embodiment of a portable beverage delivery system.

FIG. 9 shows a fifth embodiment of a beverage delivery system 400 that includes a cardboard housing 412 for housing a flexible-walled mixing chamber 414. The mixing chamber 414 is leak proof and can be constructed of a polymer such as polyethylene. A spout 442, accommodated by a spout cut out 440 through the housing 412, leads from the chamber 414 and has a removable cover 450 in which is provided a hand operable valve 452 to thereby allow controlled passage of liquid.

In operation, a user of the fifth embodiment introduces all components of a desired beverage into the chamber 414 through the spout 442 by removing the cover 450 from the spout 442 after turning the housing generally upside down. The cover 450 is replaced, and the user dispenses the completed beverage through the spout 442 into a glass or other drinking container.

As is thus apparent, the portable delivery system embodiments here taught permit preparation and delivery of a multi-component beverage through convenient on-site generation of a multi-component beverage which otherwise may not practically be packageable or transportable. While illustrative and presently preferred embodiments of the invention has been described in detail herein, it is to be understood that the inventive concepts may be otherwise variously embodied and employed and that the appended claims are intended to be construed to include such variations except insofar as limited by the prior art.

What is claimed is:

1. A portable beverage delivery system for forming a multi-component beverage, the delivery system comprising:

a) a freestanding, portable housing generally segmented into first and second portions, the housing defining first and second openings;

b) a mixing chamber having a mixer beverage therein and being accommodated within the first portion of the housing, the mixing chamber defining a closeable introduction aperture for receiving a portion of an alcoholic beverage and a closeable exit aperture for dispensing the multi-component beverage, the introduction and exit apertures being respectively exposed through the first and second openings of the housing;

c) a compartment formed within the second portion of the housing; and d) wherein a container having the alcoholic beverage therein is removably supported in the compartment so as to facilitate intermixing of the mixer beverage and the portion of the alcoholic beverage to form the multi-component beverage within the mixing chamber.

2. The delivery system of claim 1 wherein the housing is fabricated from a cardboard material.

3. The delivery system of claim 1 wherein the housing is generally segmented into the first and second portions via a wall.

4. The delivery system of claim 1 wherein the multi-component beverage is dispensed from the exit aperture by gravity force.

5. The delivery system of claim 1 wherein the exit aperture comprises a valve for selectively opening and closing the exit aperture.

6. The delivery system of claim 5 wherein the valve is integrally formed with the exit aperture.

7. The delivery system of claim 5 wherein the valve is manually operated to selectively open and close the exit aperture.

8. The delivery system of claim 1 wherein the mixing chamber is fabricated from a plastic material.

9. The delivery system of claim 1 wherein the container is a bottle.

10. The delivery system of claim 1 wherein the compartment has upper and lower border structures, and wherein the container has top and bottom portions, the upper and lower border structures being sized and configured to respectively retain the top and bottom portions of the container.

11. The delivery system of claim 10 wherein the compartment defines a void between the upper and lower border structures, the void being configured to display the container when the container is supported in the compartment.

12. The delivery system of claim 11 wherein the compartment has an inside wall, the inside wall being outwardly foldable to fill the void when the container is not supported in the compartment.

13. The delivery system of claim 1 wherein all of the alcoholic beverage from the container is intermixed with the mixer beverage within the mixing chamber to form the multi-component beverage.

14. A portable beverage delivery system for forming a multi-component beverage, the delivery system comprising:

a) a freestanding, portable housing generally segmented into first and second portions, the housing defining an opening;

b) a mixing chamber having a mixer beverage therein and being accommodated within the first portion of the housing, the mixing chamber defining a closeable aperture for receiving a portion of an alcoholic beverage and for further dispensing the multi-component beverage, the aperture being exposed through the opening of the housing;

c) a compartment formed within the second portion of the housing; and d) wherein a container having the alcoholic beverage therein is removably supported in the compartment so as to facilitate intermixing of the mixer beverage and the portion of the alcoholic beverage to form the multi-component beverage within the mixing chamber.

15. A portable beverage delivery system for forming a multi-component beverage, the delivery system comprising:

a) a freestanding, portable housing generally segmented into first and second portions;

b) a mixing chamber having a mixer beverage therein and being accommodated within the first portion of the housing;

c) a compartment formed within the second portion of the housing, the compartment having upper and lower border structures, the compartment defining a void between the upper and lower border structures, the compartment having an inside wall; and d) a container having an alcoholic beverage therein and being removably supported in the compartment so as to facilitate intermixing of the mixer beverage and a portion of the alcoholic beverage to form the multi-compartment beverage within the mixing chamber, the container having top and bottom portions, the upper and lower border structures being sized and configured to respectively retain the top and bottom portions of the container, the void of the compartment being configured to display the container when the container is supported in the compartment, the inside wall of the compartment being outwardly foldable to fill the void when the container is not supported in the compartment.

* * * * *